United States Patent [19]

Hickman

[11] Patent Number: 4,471,980

[45] Date of Patent: Sep. 18, 1984

[54] CLOSURE SAFETY LATCH MEANS

[76] Inventor: William V. Hickman, 4821 Hurley Dr., Fayetteville, N.C. 28304

[21] Appl. No.: 459,105

[22] Filed: Jan. 19, 1983

[51] Int. Cl.[3] ..... E05C 19/06

[52] U.S. Cl. ..... 292/19; 292/DIG. 2; 292/DIG. 65

[58] Field of Search ..... 312/215, 216, DIG. 33; 292/19, 20, DIG. 2, DIG. 65

[56] References Cited

U.S. PATENT DOCUMENTS 940,242 11/1909 Ferrall et al. ..... 292/19 X
1,139,316 5/1915 Van Valkenburgh ..... 292/19
3,306,643 2/1967 Reed ..... 292/347 X
4,158,271 6/1979 Barry ..... 49/386

*Primary Examiner*—Richard E. Moore
*Attorney, Agent, or Firm*—Mills & Coats

[57] ABSTRACT

In abstract, this invention relates to a safety medicine cabinet or storage compartment featuring a hinged closure which incorporates a positive latching mechanism for readily securing the cabinet from access by small children. Additionally, the safety medicine cabinet or storage compartment incorporates a closure being spring biased whereby the same is caused to close automatically and latch upon release from open position.

6 Claims, 7 Drawing Figures

CLOSURE SAFETY LATCH MEANS

FIELD OF INVENTION

The present invention relates to cabinets or storage compartments and more particularly to safety medicine cabinets which incorporate safety latches.

BACKGROUND OF INVENTION

More accidents occur in the home than any other single setting. This is due mainly to the fact that people feel safe in their homes and, therefore, do not take simple precautions that are used extensively in business and industry. Safety hazards that may exist in a home setting include a wide variety of areas. For example, poor electrical wiring may lead to fires which can result in loss of property and personal injury. The home do-it-yourselfer is notorious for coming up with a multitude of sometimes serious injuries which could have been avoided if a minimum of care was taken. Additionally the existence of children in the home greatly increases the likelihood of some type of personal injury occurring. Whether it be a bruised knee or accidental poisoning, circumstances could have been altered to reduce the risk.

In the case of poisons or equally dangerous medicines, certain precautions have to be taken in order that small children and infants do not have easy access to them. In the past, household poisons including cleaning chemicals, etc., have been stored beneath the kitchen sink where a small child can easily reach them. Additionally, both prescription and nonprescription medicines have been usually stored in the bathroom medicine cabinet. These medicine cabinets are easily reached by climbing infants and effortlessly opened by a gentle tug on the door due to the use of an inadequate friction latching mechanism.

SUMMARY OF INVENTION

The present invention provides a safety medicine cabinet or storage compartment which may be used in the home to store medicines or household chemicals such that the same can not be readily reached by young children. Additionally, the present invention incorporates a safety latch that requires manual manipulation beyond that which an infant or small child possesses to open the cabinet doors and thereby expose the contents contained therein.

The safety medicine cabinet of the present invention is basically a rectangular box having a spring biased closure and safety latch such that the same is caused to close upon release and securely latch.

In view of the above, it is an object to provide a safety medicine cabinet or storage compartment which may be used to securely store household chemicals and medicines out of the reach of infants and young children.

Another object of the present invention is to provide a safety medicine cabinet or storage compartment which is portable thereby allowing the same to be placed in a variety of locations throughout the home.

A further object of the present invention is to provide a safety medicine cabinet or storage compartment which incorporates a spring biased closure whereby the same is caused to close upon release.

Additionally, another object of the present invention is to provide a safety medicine cabinet or storage compartment which upon closing is securely latched by a safety latching mechanism of the type which cannot be manipulated by an infant or a small child.

Another object of the present invention is to provide a safety medicine cabinet or storage compartment which is compartmentalized whereby the cabinet may be oriented in either a vertical or horizontal position during use.

An even further object of the present invention is to provide a safety medicine cabinet or storage compartment which is simple in construction, economical to produce and yet provides a secure means for storing household chemicals and medicines away from small children and infants.

Other objects and advantages of the present invention will become apparent from a study of the following description and the accompanying drawings which are merely illustrative of the present invention.

DETAILED DESCRIPTION OF PREFERRED EMBODIMENT

Figure 1:
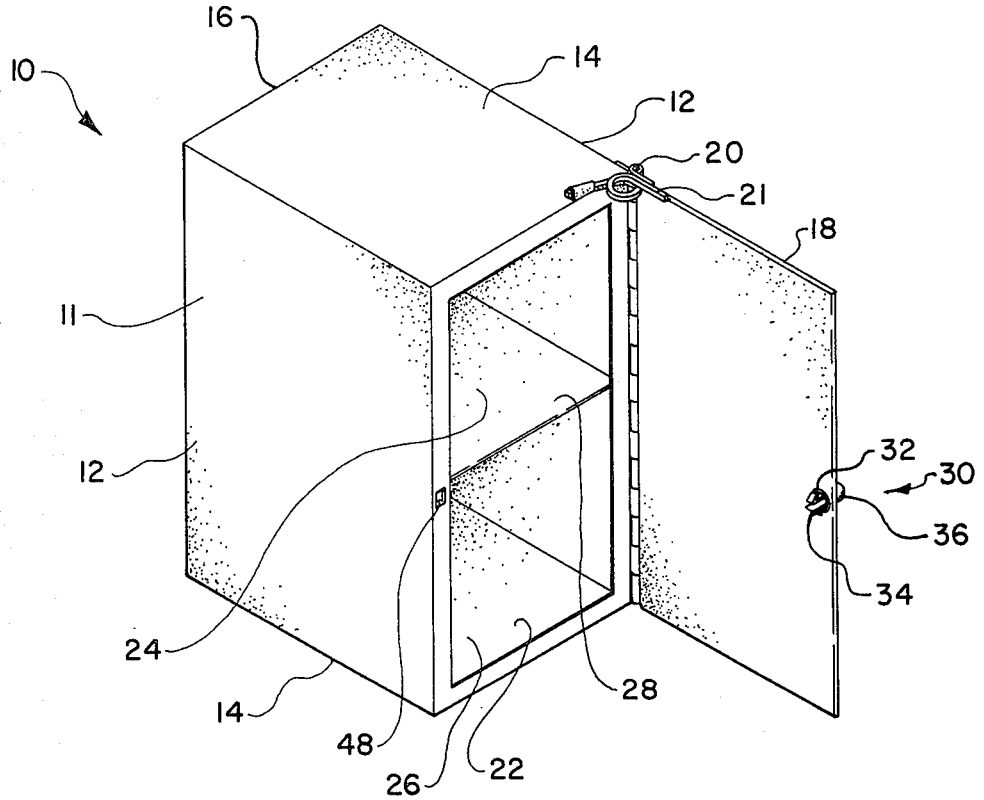
FIG. 1 is a perspective view of the safety medicine cabinet of the present invention oriented in a vertical or standing position with its spring biased closure being illustrated in the open mode.

Viewing the Figures in greater detail, particularly FIG. 1, a perspective view of the safety medicine cabinet or storage compartment of the present invention is illustrated therein and indicated generally by the numeral 10. Safety medicine cabinet 10 comprises a rectangular box 11 having side panels 12 and 14 and a back panel 16. A closure 18 is pivotably mounted along one corner of box 11 by a piano type hinge 20 whereby closure 18 may serve to close off access opening 22 of box 11 as illustrated. Additionally, closure 18 is biased in the closed mode by spring 24 thereby causing the closure to automatically cover access opening 22 and its surrounding peripheral flange 22' upon release by a user.

The interior opening of box 11 is divided into two compartments 24 and 26 by divider 28. As viewed in FIG. 1, when the safety medicine cabinet is oriented in a vertical position, the divider 28 serves as a shelf thereby allowing efficient use of the interior area. When the safety medicine cabinet or storage compartment of the present invention is oriented in a horizontal position as illustrated in FIG. 2, the divider 28 then serves to separate the interior opening into compartments 24 and 26.

Figure 2:
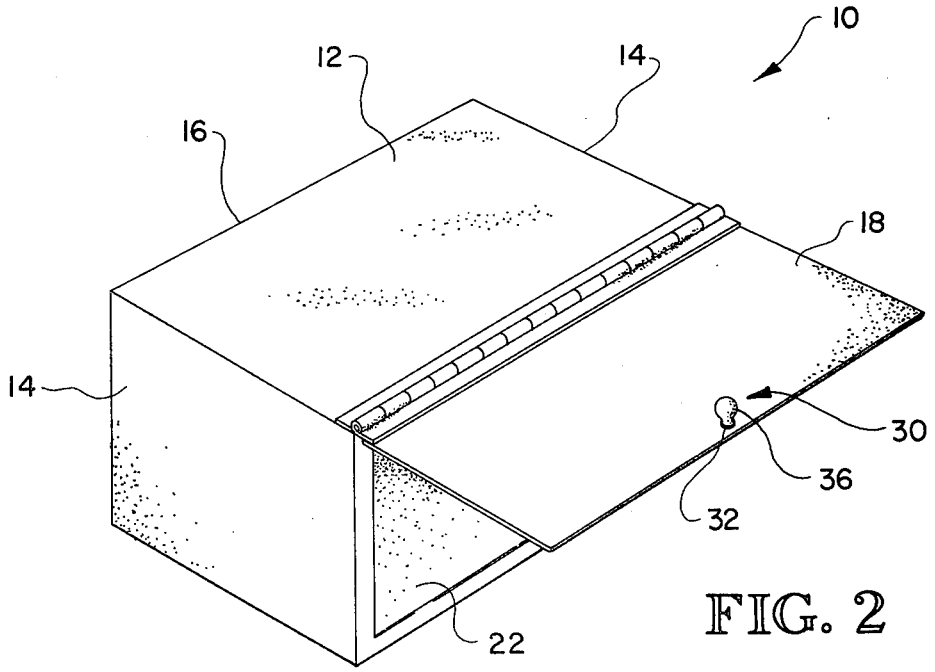
FIG. 2 is a perspective view of the safety medicine cabinet of the present invention being illustrated in a horizontal orientation.

As may be viewed in FIGS. 1 and 2, a safety latch is illustrated therein and generally indicated by the numeral 30. Safety latch 30 as shown is mounted in opening 32 formed midway the outermost edge of closure 18.

Figure 3:
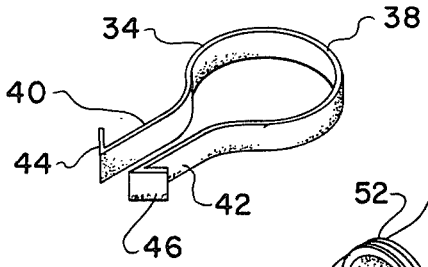
FIG. 3 is a perspective view of a leaf spring which is incorporated in the closure safety latching mechanism.
Figure 4:
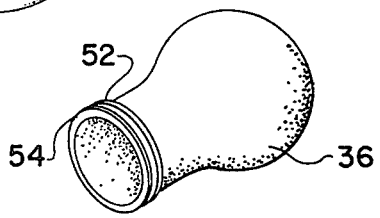
FIG. 4 is a perspective view of the flexible bulb handle which is incorporated in the safety latching mechanism of the present invention.
Figure 5:
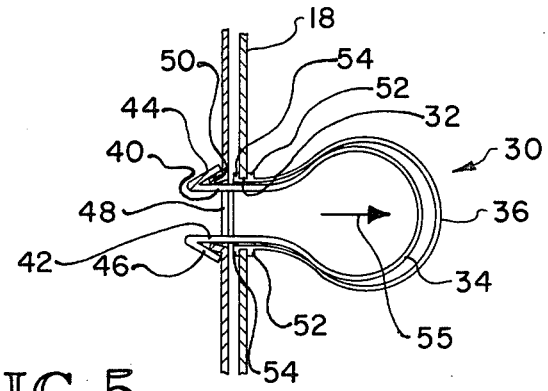
FIG. 5 is a cross sectional view of the safety latching mechanism of the present invention in the latched mode.

Safety latch 30 is composed of a leaf type spring 34 and flexible bulb 36 as illustrated in FIGS. 3 and 4, respectively. Additionally, FIG. 5 is a cross sectional view of the safety latch mechanism of the present invention illustrating the particular construction and mounting of the safety latch to closure 18, and the particular way in which safety latch 30 securely holds closure 18 in a closed mode. As can further be seen when viewing FIG. 5, leaf spring 34 is shown to be held by flexible bulb 36 in a proper aligned relationship with respect to opening 22 of closure 18.

Viewing leaf spring 34 in greater detail, the same is composed of a spring portion 38 integrally connected to extensions 40 and 42. Formed at the ends of extensions 40 and 42 are latching hooks 44 and 46, respectively. As illustrated in FIG. 5, extensions 40 and 42 of leaf spring 34 extend through opening 32 of closure 18 and into aligned latch opening 48 of peripheral flange 22'. In the latched mode, latching hooks 44 and 46 engage the interiorly projecting rims or flanges 50 formed adjacent latch opening 48.

In actual operation, elastic bulb 36 is held juxtaposed to opening 32 by ridges 52 and 54 and tends to bias leaf spring 38 outwardly from opening 32 as indicated by the arrow 55 of FIG. 5. However, as also illustrated in FIG. 5, latching hooks 44 and 46 prevent the entire leaf spring 34 from being withdrawn from opening 32.

Figure 6:
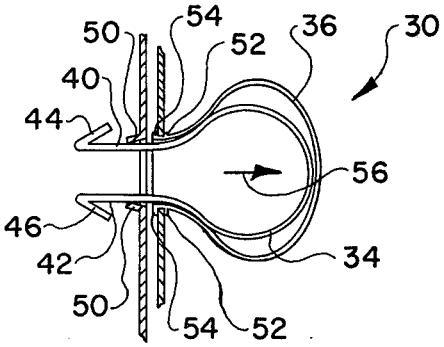
FIG. 6 is a cross sectional view of the safety latching mechanism of the present invention being shown in an intermediate phase of an unlatching procedure.
Figure 7:
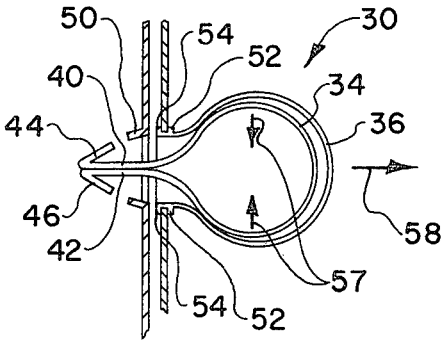
FIG. 7 is a cross sectional view of the safety latching mechanism of the present invention in an unlatched mode immediately prior to the closure being opened.

The actual operation of safety latch 30 is illustrated in FIGS. 6 and 7. First the bulb 36 is depressed as indicated by arrow 56 in FIG. 6 thereby disengaging latching hooks 44 and 46 from flanges 50 of latch opening 48. Next bulb 36 is squeezed as indicated by arrow 57 of FIG. 7 to bring spring extensions 40 and 42 adjacent each other thus allowing the outermost edges of latching hooks 44 and 46 to clear latch opening 48. The final step of opening the closure is to pull on bulb 36 as indicated by arrow 58 of FIG. 7.

From the above, it can readily be seen that operation of the safety latch 30 of the present invention is not a complicated procedure for an adult and yet does require methodical manipulation in three different steps, namely, depressing the bulb, squeezing the bulb and finally pulling the bulb to open the closure. This methodical manipulation will, of course, fail on infants or small children's efforts to gain access to the forbidden enclosure.

Upon release of closure 18 by the user, the spring biasing feature 21 of the present invention causes closure 18 to close thereby reengaging the safety latch 30 and consequently resecuring the interior of the safety medicine cabinet from access by one unable to manipulate the safety latching mechanism.

It is obvious from the foregoing specification that the safety medicine cabinet of the present invention presents a storage compartment which refuses access to articles placed therein from infants and small children which are unable to manually manipulate the safety latching mechanism thereon. Additionally, the spring biasing feature of the present invention provides an automatic fail safe closing feature which automatically secures the cabinet in the event that the last user may forget to close the same. Furthermore, the present invention provides a portable storage compartment that can be placed in any area of the home to reduce the risk of poisoning of small children and infants due to the swallowing of common household chemicals and drugs.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A safety latch means for storage compartments and similar enclosures having an access opening therein comprising: a closure; biasing means for moving said closure means to the closed position relative to said opening when unattended; and automatically engaging safety latching means including at least two extension means disposed generally parallel to each other; means for biasing said extension means apart; outwardly disposed, beveled in configuration, locking hook means on the outer end of said extension means; a latch opening associated with said enclosure for receiving said locking hook ends of said extension means; and inwardly projecting flange means disposed adjacent at least a portion of the periphery of said latch opening for interengaging said locking hooks whereby, when the closure means biasingly moves to the closed position, said locking hooks will pass through said latch openings and engage said interior flanges thereby interengagingly locking the same and requiring inward movement of said extensions to disengage said hooks from said flanges, squeezing movement to dispose said extensions substantially adjacent each other to allow said latching hooks to pass through said latch opening, and outward movement to remove said extensions and their associated locking hooks from said opening when said closure is opened to give access to the interior of said enclosure.

2. The safety means of claim 1 wherein the compartment enclosure is portable.

3. The safety means of claim 2 wherein said portable enclosure is elongated, generally rectangular in configuration and so sized to be either vertically or horizontally disposed within storage type cabinets.

4. The safety means of claim 3 wherein said elongated, generally rectangular shaped enclosure includes a centrally disposed divider whereby such divider may be used as either a shelf or partition depending on whether the same is disposed vertically or horizontally.

5. The safety means of claim 1 wherein the locking hook means, the extension means, and the biasing means for said extension means are all formed from a single piece of spring steel.

6. The safety means of claim 5 wherein a bulbous shaped cover is disposed about the portion of said extension and biasing means disposed exteriorly of said closure means.

* * * * *